US008356909B2

(12) United States Patent
Verjans et al.

(10) Patent No.: US 8,356,909 B2
(45) Date of Patent: Jan. 22, 2013

(54) ILLUMINATED TILING SYSTEM

(75) Inventors: Conrad Wilhelmus Adriaan Verjans, Drachten (NL); Georg Sauerlaender, Aachen (DE); Joseph Hendrik Anna Maria Jacobs, Eygelshoven (NL); Dirk Hente, Wuerselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 390 days.

(21) Appl. No.: 12/811,391

(22) PCT Filed: Jan. 5, 2009

(86) PCT No.: PCT/IB2009/050009

§ 371 (c)(1), (2), (4) Date: Jul. 1, 2010

(87) PCT Pub. No.: WO2009/087585

PCT Pub. Date: Jul. 16, 2009

(65) Prior Publication Data

US 2010/0284173 A1 Nov. 11, 2010

(30) Foreign Application Priority Data

Jan. 10, 2008 (EP) ..... 08100294

(51) Int. Cl.
*F21S 8/00* (2006.01)

(52) U.S. Cl. ..... 362/145; 362/153; 362/147; 362/652

(58) Field of Classification Search ..... 362/145, 362/147, 153, 153.1, 576, 249.02–249.06, 362/652, 653, 253, 800

See application file for complete search history.

(56) References Cited

U.S. PATENT DOCUMENTS

| | | | | |
|---|---|---|---|---|
| 6,932,489 | B2 * | 8/2005 | Sooferian | 362/145 |
| 6,958,182 | B2 * | 10/2005 | Hasecke et al. | 428/67 |
| 7,607,793 | B2 * | 10/2009 | Coushaine et al. | 362/145 |
| 8,092,034 | B2 * | 1/2012 | Zarian et al. | 362/145 |
| 8,235,542 | B2 * | 8/2012 | Yohananoff | 362/153.1 |
| 2004/0022058 | A1 | 2/2004 | Birrell | |
| 2005/0116667 | A1 | 6/2005 | Mueller et al. | |
| 2005/0248935 | A1 | 11/2005 | Strip et al. | |
| 2008/0019121 | A1 * | 1/2008 | Ly | 362/145 |
| 2008/0037284 | A1 * | 2/2008 | Rudisill | 362/629 |
| 2008/0205078 | A1 * | 8/2008 | Karlicek et al. | 362/612 |
| 2009/0034241 | A1 * | 2/2009 | Coushaine et al. | 362/145 |

FOREIGN PATENT DOCUMENTS

| | | |
|---|---|---|
| DE | 29810124 | 8/1999 |
| DE | 20102832 | 5/2001 |
| DE | 202004001644 | 5/2004 |
| DE | 10313779 | 10/2004 |
| DE | 102005002783 | 8/2005 |
| EP | 1469141 | 10/2004 |
| EP | 1691003 | 8/2006 |
| FR | 2712377 | 5/1995 |
| FR | 2718197 | 10/1995 |

(Continued)

*Primary Examiner* — Bao Q Truong
(74) *Attorney, Agent, or Firm* — Mark L. Beloborodov

(57) ABSTRACT

The invention relates to an illuminated tiling system (100) which comprises back panels (10) with at least one electrically conductive layer (12, 13), plugs (20) with projections (21, 23) that electrically contact the conductive layer(s) (12, 13), and light-tiles (30) with (O)LEDs that can be fixed to the plugs. For an easy tiling, dummy-tiles can first be tiled together with conventional tiles (2) and later be replaced with the light-tiles (30).

5 Claims, 2 Drawing Sheets

FOREIGN PATENT DOCUMENTS

| | | |
|---|---|---|
| GB | 2407633 | 5/2005 |
| WO | 9403947 | 2/1994 |
| WO | 2007112851 | 10/2007 |
| WO | 2007115736 | 10/2007 |

* cited by examiner

ILLUMINATED TILING SYSTEM

FIELD OF THE INVENTION

The invention relates to an illuminated tiling system, a dummy-tile for such a system, and a method for tiling a wall using such an illuminated tiling system.

BACKGROUND OF THE INVENTION

The WO 2007/112851 A1 discloses illuminated tiles comprising an organic light emitting diode (OLED) in a housing. Snap-in elements at the back of the housing cooperate with corresponding snap-in elements preinstalled on the wall to connect the OLED to an electrical power supply. A problem of this approach is that the components on the wall have to be precisely located in advance.

SUMMARY OF THE INVENTION

Based on this background it was an object of the present invention to provide an illuminated tiling system that is simple and cost-effective with respect to its production and/or installation.

This object is achieved by an illuminated tiling system according to claim 1, a dummy-tile according to claim 8, and a method according to claim 9. Preferred embodiments are disclosed in the dependent claims.

An illuminated tiling system according to the present invention comprises the following components:

a) At least one back panel with at least one electrically conductive layer covered on at least one side by an (electrically) insulating material. As its name indicates, the back panel has preferably a flat, plate like shape with the conductive layer extending parallel to the plane of plate. The conductive layer preferably covers the whole area of the back panel, though it may optionally also be restricted to some sub-area. It is typically made of a metal like copper, while the insulating material is typically a plastic. Moreover, the back panel is preferably flexible enough to allow an adaptation to a possibly non-planar surface of a wall.

b) At least one plug with an electrical terminal, which will be called "plug-terminal" in the following, and with a projection that can be pierced into the aforementioned back panel to electrically connect the conductive layer of said back panel to the plug-terminal. In the most simple case, the projection may be a metallic pin (like a nail); preferably, it is however a composed structure comprising an insulating carrier material with embedded electrical lines. While the main purpose of the projection is to make electrical contact to the conductive layer of the back panel, it may optionally also attach the plug mechanically to the back panel. If the back panel comprises more than one conductive layer, the projection may be adapted to electrically connect a single, all, or any subset of these layers to corresponding plug-terminals.

c) At least one light-tile having a light emitting diode (LED) as light source with at least one electrical terminal, which will be called "tile-terminal" in the following and which is electrically coupled to the plug-terminal of the aforementioned plug when the light-tile is attached to the plug. In this context, the "electrical coupling" shall by definition allow for a transfer of electrical energy and/or signals.

Though the minimal number of each component (back panel, plug, light-tile) is one, the system will typically comprise a plurality of each of them.

The described illuminated tiling system provides a very flexible and easy-to-use approach for integrating light-tiles into a conventional tiling of a wall, because the back panel with its conductive layer(s) provides an electrical power supply within large areas of the wall, optionally over the whole wall. This power supply can be contacted at any desired location by simply piercing the plug of the system into the back panel, wherein this piercing can be done after conventional tiling, i.e. when the exact place for the desired light-tile is known. Said light-tile can then be connected to the plug, thus providing the desired illumination within the tiling.

The illuminated tiling system preferably further comprises a "dummy-tile" having similar dimensions as the light-tile and/or the light-tile plus the plug (but having no functional components). The dummy-tile can be used as a placeholder for a light-tile during the tiling of a wall. Said tiling can therefore be executed as usual, i.e. without the need to care about a (sensitive) light-tile. Once the tiling is complete, the dummy-tile can be exchanged with a light-tile.

In order to facilitate the aforementioned exchange of a dummy-tile with a light-tile, the dummy-tile may preferably have a surface that is not adhesive with respect to a given tiling mortar, cement, or glue as it is used for tiling. Even if such a dummy-tile is placed into the same binding agent as the conventional tiles, this will not hinder its later removal. Moreover, the dummy-tile may optionally have means like a tongue, a hook, a notch or the like that facilitate to grip it manually or with a tool.

The LED light source that is integrated into the light-tile is preferably an organic light emitting diode (OLED). OLEDs have inter alia the advantages to provide a robust, homogenous large area illumination, which has a cold surface and variable color.

The electrical coupling between the plug-terminal and the tile-terminal, which allows the transfer of electrical energy and/or signals from the conductive layer(s) of the back panel to the light source, may for example be achieved by a direct electrical (physical) contact between these terminals. Alternatively, the terminals may be wirelessly coupled. In the latter case, the terminals are designed as (small) antennas or coils that emit and receive energy via electromagnetic waves. A wireless coupling has the advantage that the terminals can completely be embedded into an isolation that protects them from corrosion.

The main task of the plug is to provide the plug terminal(s) via which the light-tile can be coupled to the conductive layer(s) in the back panel. Optionally the plug and the light-tile may further comprise cooperating connection units for also mechanically coupling them. The connection units may for example be of a plug-socket type, with the male unit located on the light-tile and the female unit on the plug or vice versa. Mechanically attaching the light-tile to the plug makes the fixation of the light-tiles independent of the glue or mortar used for fixation of the conventional tiles. Moreover, such a connection is typically reversible, i.e. the light-tile can readily be exchanged if necessary.

The illuminated tiling system may further optionally comprise at least one connector for electrically connecting corresponding conductive layers of adjacent back panels. Thus a plurality of back panels can be placed side-by-side to cover a wall area that shall be tiled with corresponding conductive layers of neighboring back panels being on the same electrical potential.

The invention further relates separately to a plug, to a light-tile, and to a dummy-tile, respectively, for an illuminated tiling system of the kind described above, because these elements can be manufactured and sold as products of their own.

Moreover, the invention relates to a method for tiling a wall using an illuminated tiling system of the kind described above which comprises a dummy-tile. It should be noted that the term "wall" is to be understood in the context of the present invention in a most general sense, i.e. as denoting any area that shall be tiled (e.g. a floor, ceiling, upright room wall etc.). The method comprises the following steps:

a) Attaching at least one back panel of the illuminated tiling system to the wall. This attachment may be achieved by any appropriate means, for example by gluing or screwing.

b) Attaching a dummy-tile to the back panel. The attachment may mechanically be made directly to the back panel and/or via the plug mentioned below. Moreover, the attachment may be achieved by embedding the dummy-tile into the mortar, cement, or glue with which also conventional tiles are fixed.

c) Attaching conventional tiles (e.g. ceramic tiles) to the back panel. This attachment of conventional tiles may be done before, during and/or after the attachment of the dummy-tile.

d) Removing the dummy-tile (50), wherein this removal is typically done after the attachment of the conventional tiles has become sufficiently fixed, e.g. after the used mortar has hardened.

The term "conventional tiles" comprise all kind of regularly or irregularly shaped tiles, mosaics or flagstones suitable to cover a wall and/or a back panel.

The steps a) to d) may be executed in any possible sequence and/or in parallel. It is in particular possible to first tile the whole wall with conventional tiles and then replace at least one of these tiles with the dummy-tile.

Due to the application of a dummy-tile as a placeholder, the described method allows to tile a wall uniquely as if only conventional tiles would be used. Only after this tiling has been finished, the (sensitive) light-tiles are inserted at the desired places by changing them against the dummy-tiles.

To accomplish the tiling process of the wall, it is required that at least one plug of the illuminated tiling system is pierced into the back panel such that it electrically contacts the at least one conductive layer of the back panel. This piercing may be done before the dummy-tile is attached to the back panel (step c) or after it has been removed from the back panel (step d). The first variant has the advantage that mortar or glue which may be present on the back panel where the plug shall be inserted is still soft.

After the plug has been fixed, a light-tile can be attached at the position of the plug, e.g. by directly attaching it to the plug and/or to the associated back panel.

These and other aspects of the invention will be apparent from and elucidated with reference to the embodiment(s) described hereinafter. These embodiments will be described by way of example with the help of the accompanying drawings.

DETAILED DESCRIPTION OF EMBODIMENTS

Like reference numbers in the Figures refer to identical or similar components.

Tiles and mosaics as they are for example found in bathrooms provide nice opportunities for incorporating a lighting, wherein a "mosaic" is by definition a regular or irregular pattern of (typically small) flagstones. As light sources, LEDs can be used in this case. To avoid a point source characteristic, it is further preferred to use OLEDs as light sources, which offer the following advantages:

homogeneous light;
extreme small thickness;
large area;
easy dimmable;
cold surface;
color variability;
different forms (e.g. letters, symbols);
variable off-state appearance.

When trying to incorporate light sources into a tiling or mosaic, the following problems have to be faced:

Pre-installation of the light sources is practically impossible, because the exact position has to be known as the alignment of the tiles is very critical.

Additionally, space behind the tiles is limited, so no wires can be placed behind the flagstones. Flexing grooves for wires into the wall is also not practical, as it is too difficult and too expensive.

Hiding wires in seams between the tiles is disadvantageous, as the areas with wires can be seen after putting grout into the seams.

The above problems are in most cases further aggravated by the fact that the number of light sources is relatively high (typically larger than 10 per $m^2$). Hence, a large amount of cables has to be handled and a lot of space is required.

Figure 1:
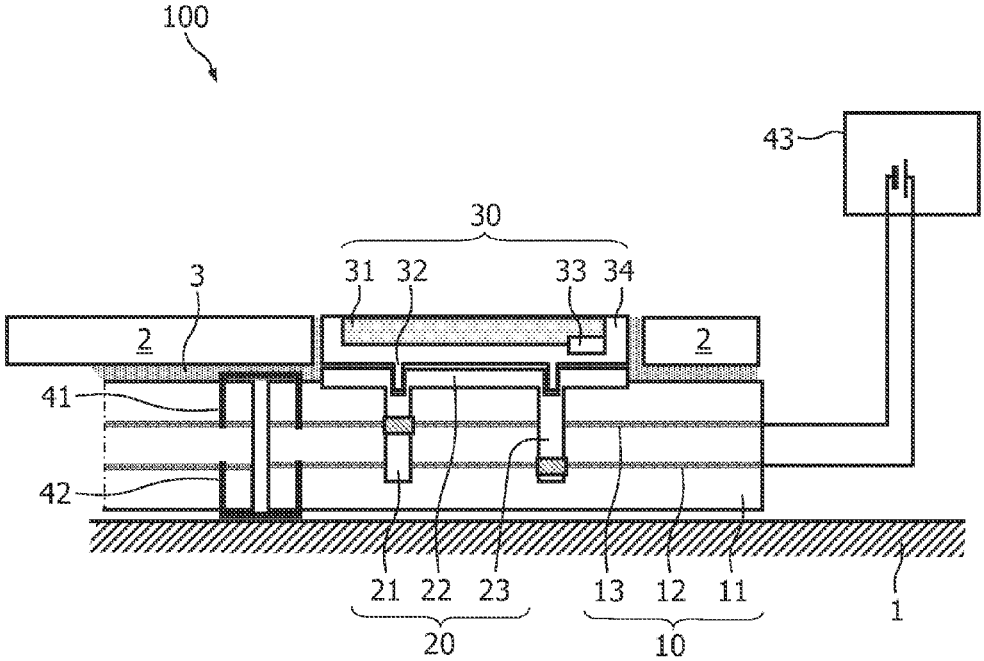
FIG. 1 shows schematically a section through the surface of a wall that is covered with an illuminated tiling system according to the present invention.

FIG. 1 shows schematically a section through an illuminated tiling system 100 according to the present invention that addresses the above problems. The illuminated tiling system 100 comprises three basic components:

As a first component, it comprises at least one back panel 10. The back panel 10 consists of an (electrically and optionally also acoustically and/or thermally) insulating material 11 into which two parallel electrically conductive layers 12, 13 are embedded. Typically, the whole area of a wall 1 is covered with such back panels 10 in a seamless manner, wherein corresponding conductive layers of adjacent back panels 10 are electrically connected. This may for example be achieved by staples 41, 42 as schematically shown in FIG. 1, or, preferably, by some kind of side connectors.

The thickness of the back panel 10 preferably ranges from 10 to 50 mm with a typical value of 20 mm. The area of the back panels 10 is usually several times as large as the area of conventional tiles, e.g. 1 $m^2$. The back panels 10 preferably have some flexibility to be able to adapt to the contour of a wall.

As in the shown example, the back panel 10 will typically comprise two conductive layers 12, 13, though it might also comprise just one or more than two such layers. Back panels of this kind are commercially available (e.g. SAITEC S.A., CHALLANS, FRANCE) and described for example in FR2718197 A1, FR2712377 A1, DE 29810124 U1, or WO 94/03947 A2.

As a second component, the illuminated tiling system 100 comprises a plug 20 which can be pierced at any desired position into the back panel 10 and which has the task to electrically contact the conductive layers 12, 13. In the embodiment of FIG. 1, the plug 20 comprises two projections 21, 23 extending into the back panel 10, each of them contacting a different conductive layer. The projections 21, 23 are connected by a bridge 22 comprising two outward facing holes 24. The plug 20 is typically made from a plastic in which metallic electrical leads are embedded as necessary.

As a third component, the illuminated tiling system 100 comprises a light-tile 30 which comprises an OLED 31 mounted in a housing 34. At the back of the housing 34, two pins 32 project towards the wall which can be inserted into the holes 24 of the plug 20 in a form-fitting manner to attach the light-tile 30 to the plug 20. As will be explained below, the pin 32 further provide for the OLED 31 electrical contact to a power supply.

The light-tile 30 further comprises some circuitry 33 with electrical components necessary for driving the OLED. Thus the circuitry 33 may for example comprise a DC to current converter topology or means for dimming.

FIG. 1 further shows that the light-tile 30 is embedded between conventional tiles 2 that are attached with some mortar or glue 3 to the back panels 10. It should be noted that the wall 1 can be anything that shall be covered with tiles or mosaics, e.g. a (vertical) wall in the narrower sense, a floor, a ceiling, a roof, or an object. In a mosaic, a typical size of the tiles 2 and/or the light tile 30 is about 2 cm×2 cm.

Figure 2:
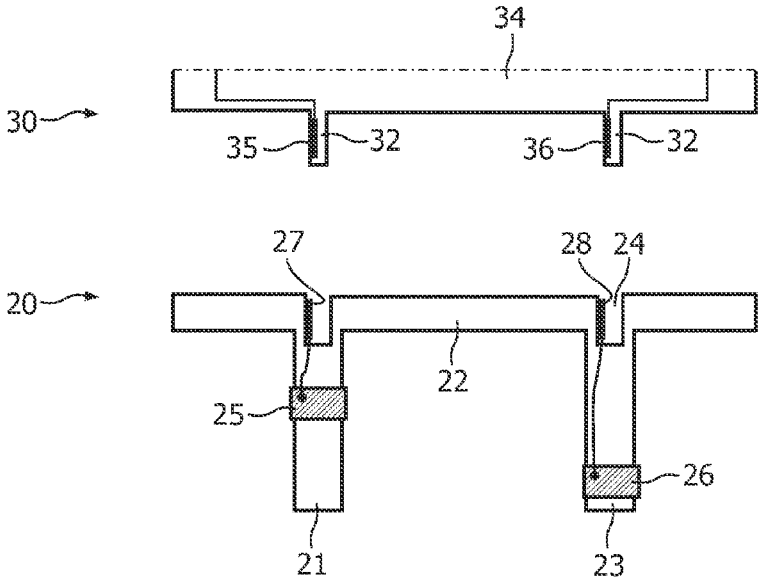
FIG. 2 shows in detail a section through the plug and the bottom side of a light-tile of the system of the FIG. 1.

FIG. 2 shows in more detail the plug 20 and the corresponding bottom of the light-tile 30. In this example, the plug 20 comprises two projections 21, 23 which can be pierced into a back panel. The two projections 21, 23 comprise electrical contacts 25, 26 at different heights such that they will come into contact with different conductive layers 12, 13 of a back panel 10 when the plug is completely pierced into it. The contacts 25 and 26, which can be rings on the outside of the projections 21 and 23, are internally electrically connected to "plug-terminals" 27 and 28, respectively, located inside the holes 24 on the outer side of the plug 20.

As already mentioned, the light-tile 30 comprises corresponding pins 32 at its bottom side which fit into the holes 24. The pins 32 comprise "tile-terminals" 35, 36 which come into contact with the plug-terminals 27, 28 when the pins 32 are inserted into the holes 24 and which are internally connected to the OLED 31 and/or the circuitry connected thereto.

It should be noted that the particular shape and size of the plug 20 can differ from the embodiment shown in the Figures. Thus the plug could for example have just one projection (with two electrodes). Moreover, the terminals 27, 28 and 35, 36 could optionally be designed (e.g. as coils) for a wireless energy transfer and be embedded into an isolating material.

The back panels 10 are connected to a power supply 43 which should produce the correct voltage and current. Hence it should be adjusted to the requirements of the light modules. Preferably DC voltage is used. This voltage can also be used to dim the light modules. Possibilities for dimming are:

- Varying the supply voltage as described above.
- Installation of one or more additional power lines.
- Superposition of a communication signal (power line communication).
- Wireless communication, e.g. Bluetooth, RF, etc.

In the following, a preferred method for manufacturing the tiling of FIG. 1 will be described with reference to FIG. 3.

Figure 3A:
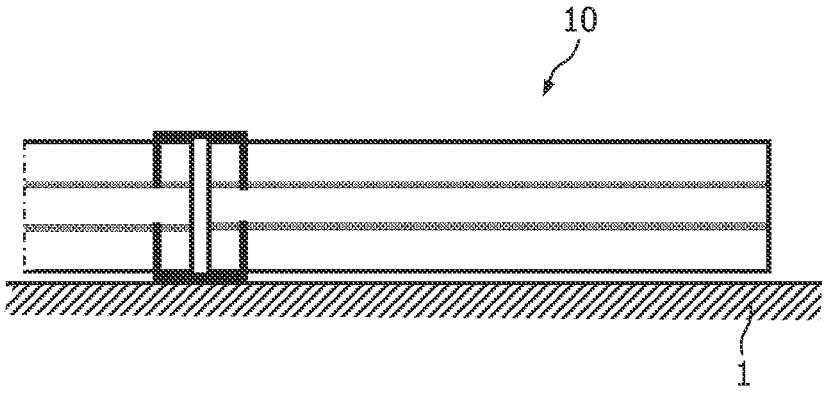
FIG. 3 shows consecutive stages of the fabrication of the tiling system of FIG. 1.

According to FIG. 3*a*, the wall 1 first needs to be prepared before the tiling process starts. This preparation will result in a flat surface. On the prepared surface, the electrically conductive back panels 10 are glued, which later will transport current over the wall. All panels will be interconnected by means of connectors lugged into the panels (preferably as side connections).

Figure 3B:
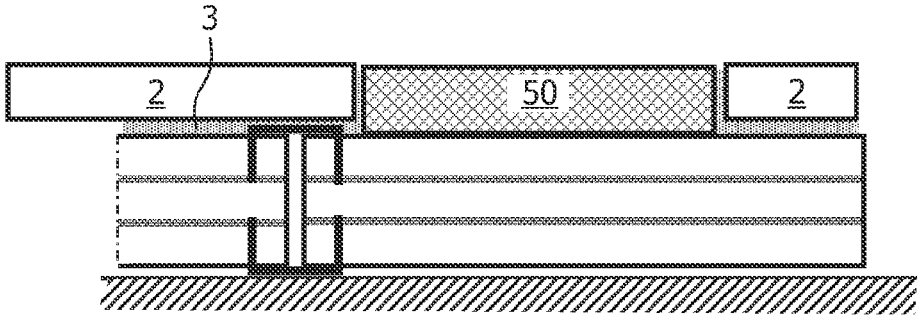

After the glue is set, the next step shown in FIG. 3*b* is the actual tiling process with conventional tiles 2 including the grouting. At the positions where a light source is needed, a dummy-tile 50 will be inserted as a placeholder that is chemically inert to the glue 3. The dummy-tile 50 can for example be made of plastic with rubber properties (as a molded part) and/or of wood. It is used to keep the tiling process standard and place the light sources afterwards.

While the Figure suggests that the dummy-tile 50 is inserted at its position instead of a conventional tile from the beginning on, it is also possible to first fill this place with a conventional tile, then remove this and replace it with the dummy-tile. The latter method may particularly be applied for mosaics in which a plurality of tiles is attached to a grid; in this case it may be advantageous to first attach the complete grid to the back panel and then remove single tiles from the grid and replace them with dummy-tiles.

Figure 3C:
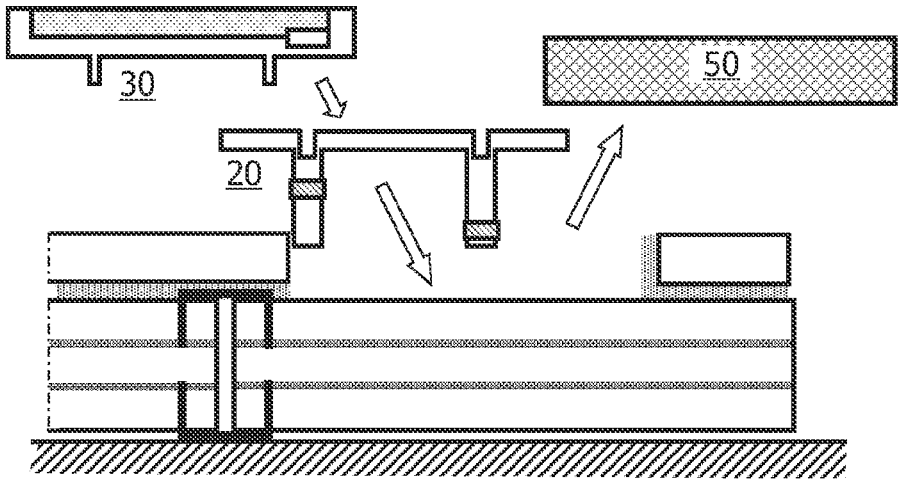

Once the tiles or mosaics are installed and the grout is set, the next phase shown in FIG. 3*c* can start. The dummy-tiles 50 are removed and electrically conductive plugs 20 (one or more per OLED) are placed into the wall where needed. These plugs 20 will be inserted like a staple. They make electrical contact to the conductive layers in the back panel on their outside and provide an electrical and mechanical contact on their inside.

It should be noted that the plugs 20 can alternatively be inserted into the back panel before the dummy-tile 50 is attached. This has the advantage that mortar or glue which may be present on the back panel is still soft and therefore easy to penetrate.

The last step is to put the light-tiles 30 with the OLEDs into the plugs 20 and thereby create electrical contact with the conductive layers. Now the installation is ready and the power supply and driver 43 can be attached to light up the installation. Dimming can be achieved by changing the voltage applied to the back panels.

In summary, the described method comprises the following steps:

- Installation of the back panels including installation of the power supply.
- Installation of the mosaic tiles.
- Removing of those tiles at positions at which the light modules have to be installed later (or leaving these positions free from the start).
- Installation of the dummy; dispensable glue can be removed.
- Drying process.
- Replacement of the dummies by the light modules.
- Filling the grooves with grout.

The described illuminated tiling system 100 offers the following advantages:

- it is flat;
- it is scalable;
- no separate wires are needed towards each light source;
- light sources can be located everywhere, no alignment problems;
- the placement of the light sources can be done after the tiling process;
- replacement of the light sources is easy.
- the solution is serviceable in the future.

Of course many variations of the described particular embodiments are possible, for example:

The back panel could contain a third (or more) conductor layer, used for data communication to add dynamics to the light sources.

Data communication can also be added over the two conductor layers as known from other power/data communication combinations used in wires.

Data communication can be done wirelessly.

Dimming can be created in other ways, e.g. PWM or AM or via data communication.

Color variability can be introduced via data communication or separate conductors in the back panels.

The described OLEDs with socket-base construction can be applied in general lighting, decorative lighting, lighting for public spaces, indoor lighting, outdoor lighting, city beautification, ambient lighting, creation of tiled areas, tiled objects, mosaics, etc.

Finally it is pointed out that in the present application the term "comprising" does not exclude other elements or steps, that "a" or "an" does not exclude a plurality, and that a single processor or other unit may fulfill the functions of several means. The invention resides in each and every novel characteristic feature and each and every combination of characteristic features. Moreover, reference signs in the claims shall not be construed as limiting their scope.

The invention claimed is:

1. An illuminated tiling system, comprising a) at least one back panel comprising at least one electrically conductive layer covered by an isolating material;

b) at least one plug comprising a plug terminal and a projection configured to pierce into the back panel to electrically connect the conductive layer to the plug terminal;

c) at least one light tile comprising an LED light source and at least one tile terminal electrically coupled to the plug terminal when the light tile is attached to the plug; and d) at least one dummy tile having similar dimensions as the light tile.

2. The illuminated tiling system according to claim 1, wherein the light source comprises an OLED.

3. The illuminated tiling system according to claim 1, wherein the plug terminal and the tile terminal either contact each other or wirelessly coupled.

4. The illuminated tiling system according to claim 1, wherein the plug and the light tile comprise cooperating connection units for facilitating mechanically coupling therebetween.

5. The illuminated tiling system according to claim 1, wherein the plug comprises at least two projections for connecting different conductive layers of the back panel with different plug terminals.

* * * * *